US012607076B2

(12) United States Patent
Skärgård

(10) Patent No.: US 12,607,076 B2
(45) Date of Patent: Apr. 21, 2026

(54) RISER SUSPENSION DEVICE WITH MOVEMENT LIMITER

(71) Applicant: Enhanced Drilling AS, Straume (NO)

(72) Inventor: Gustav Olov Skärgård, Oslo (NO)

(73) Assignee: ENHANCED DRILLING AS, Straume (NO)

( * ) Notice: Subject to any disclaimer, the term of this patent is extended or adjusted under 35 U.S.C. 154(b) by 0 days.

(21) Appl. No.: 18/867,208

(22) PCT Filed: May 16, 2023

(86) PCT No.: PCT/NO2023/050112
§ 371 (c)(1),
(2) Date: Nov. 19, 2024

(87) PCT Pub. No.: WO2023/224490
PCT Pub. Date: Nov. 23, 2023

(65) Prior Publication Data

US 2025/0347181 A1 Nov. 13, 2025

(30) Foreign Application Priority Data

May 20, 2022 (NO) ..... 20220601

(51) Int. Cl.
*E21B 19/00* (2006.01)

(52) U.S. Cl.
CPC ..... *E21B 19/006* (2013.01)

(58) Field of Classification Search
CPC ..... E21B 19/006; E21B 19/004
See application file for complete search history.

(56) References Cited

U.S. PATENT DOCUMENTS 9,284,796 B2 * 3/2016 Hoefler ..... E21B 19/004
2015/0167404 A1 6/2015 Hoefler et al.
2019/0009866 A1 1/2019 Jones

FOREIGN PATENT DOCUMENTS

WO 2011/133552 A1 10/2011
WO 2015/022425 A1 2/2015

OTHER PUBLICATIONS

International Search Report issued in corresponding International Application No. PCT/NO2023/050112, dated Jul. 17, 2023, pp. 1-3.
Written Opinion of the International Searching Authority issued in corresponding International Application No. PCT/NO2023/050112, dated Jul. 17, 2023, pp. 1-4.
Search Report issued by the Norwegian Patent Office on Mar. 27, 2023 in corresponding NO Patent Application No. 20220601.

* cited by examiner

*Primary Examiner* — James G Sayre
(74) *Attorney, Agent, or Firm* — Carter, DeLuca & Farrell LLP; George Likourezos

(57) ABSTRACT

A gimbal device for suspending a riser on a mobile offshore drilling vessel (MODU), having a first frame, a second frame and a plurality of cushioning units, wherein each of the said plurality of cushioning units are circumferentially positioned in between the first frame and the second frame. The gimbal device further includes a plurality of tethering items, which are separate from the cushioning units and configured to take up tensioning loads. The plurality of tethering items are circumferentially positioned in between the first frame and the second frame.

9 Claims, 3 Drawing Sheets

RISER SUSPENSION DEVICE WITH MOVEMENT LIMITER

CROSS-REFERENCE TO RELATED APPLICATION(S)

This is a national stage application filed under 37 U.S.C. 371 based on International Patent Application No. PCT/NO2023/050112, filed May 16, 2023, which claims priority to Norwegian patent application No. 20220601 filed May 20, 2022, the entire contents of which are incorporated herein by reference in their entirety.

TECHNICAL FIELD

The present invention relates to a device for suspending a riser from a floating vessel, such as from the deck of a mobile offshore drilling unit.

BACKGROUND ART

During offshore drilling operations, marine drilling risers are subject to substantial loads from both the ocean and use by mobile offshore drilling units (MODU), such as drill rigs/ships and well intervention units. Marine drilling risers are designed to be robust during operation in the harsh offshore environment, wherein risers act as a conduit between a MODU and a blow-out preventer (BOP). MODUs can limit the effect of surge, sway and yaw through the use of mooring systems and/or dynamic positioning thrusters, in order maintain a fixed position above the subsea wellhead for the riser string and BOP. However, the riser design must take into account cyclic forces from the ocean when connected to the former and latter, such as heave, pitch and roll, in addition to forces deriving from operational use, such as holding the weight of the BOP, raising and lowering of the riser string, etc.

Also, in the case of a potential blow-out during drilling operations, such as a gas blow-out, a last-ditch emergency protocol is to immediately disconnect the BOP from the subsea wellhead and move away from vicinity above the subsea wellhead. A reason for such a protocol is that the gas blow-out may negatively affect the buoyancy and stability of the MODU if caught by the gas bubbles deriving from the gas blow-out. In such a situation, the BOP is dragged away by the MODU, whereas the riser string is significantly strained at the connection points throughout the process.

In order to take into account the forces affecting marine offshore risers during operation, MODUs have onboard devices to counter-act said forces. One such device is a two-axis gimbal, which suspends a riser string from the work deck of a MODU and provides a pivoted support system for the riser. A gimbal permits limited rotational movements of the riser for counter-acting pitch and roll forces affecting the MODU, assisting the riser string to keep upright relative to the horizon.

Said gimbals can be provided in different forms. One gimbal design utilizes spherical or roller bearings to reduce the bending moments on the riser deriving from movement of a MODU. A disadvantage of such solution is they are not efficient in reducing the bending moments on the riser at the suspension point, especially during deep water operations with high riser loads.

Another alternative are gimbals comprising of two circular frames with a set of cushioning items, e.g., rubber elements, pneumatic or hydraulic cylinders, circumferentially installed in between the frames, with the riser suspended in the center of the frames. Such gimbals would be more efficient in reducing the bending moments on the riser at the suspension point than the previously example with spherical or roller bearings.

Above mentioned gimbals are more or less disclosed as prior art in US2015167404A1, which discloses a gimbal device for supporting of a riser from a floating vessel comprising of two circular frames with a set of cushioning items. The cushioning items are placed in a circumferential manner between a first frame and second frame. Said gimbal assembly has an opening in the centre formed about an axis enclosing the tubular member.

Another gimbal is disclosed in WO2015022425A1, that describes a gimbal for use on floating vessels installed below a spider on drill floor enclosing the riser to allow for controlled suspension of riser, wherein the first plate is fixed to a deck of the vessel. The middle plate is hingededly connected to the bottom plate through bearings and is adapted to tilt relative to the bottom plate about a horizontal axis. The top plate is arranged above the middle plate and is hingededly connected to the middle plate through the bearings. The top plate is adapted to tilt relative to the middle plate about a horizontal second central axis. The first central axis and the second central axis are arranged perpendicular to each other in a rest position of the gimbal.

US2019009866A1 discloses another gimbal device in a vessel that utilizes bearing for rotations in the transvers and/longitudinal direction.

However, the cushioning items of such gimbals would be susceptible to large compressional and/or tensional loads which may deform the cushioning to such an extent that bending moments will act on the riser at the gimbal suspension point.

It is therefore coveted an inventive technical solution that contribute to limit destructive compression and/tension of cushioning items of gimbal system, which may otherwise lead to the development of large bending moments on a marine drilling riser at the suspension point of a gimbal.

SUMMARY OF INVENTION

It is an object of the present invention to provide an inventive suspension device, a gimbal, for suspending a work string, such as a marine drilling riser, at its drill floor or cellar deck and providing the marine drilling riser a predetermined allowance of pitch and roll when suspended at the gimbal.

The object is preferably achieved by a gimbal device for suspending a riser on a mobile offshore drilling vessel (MODU), comprising a first frame, a second frame and plurality of cushioning units, wherein each of the said plurality of cushioning units are circumferentially positioned in between the first frame and the second frame, wherein the gimbal device further comprise of a plurality tethering items, wherein of the said plurality of tethering items are circumferentially positioned in between the first frame and the second frame.

The object of the present invention is further achieved as described in the following claims.

DETAILED DESCRIPTION OF THE INVENTION

Figure 1:
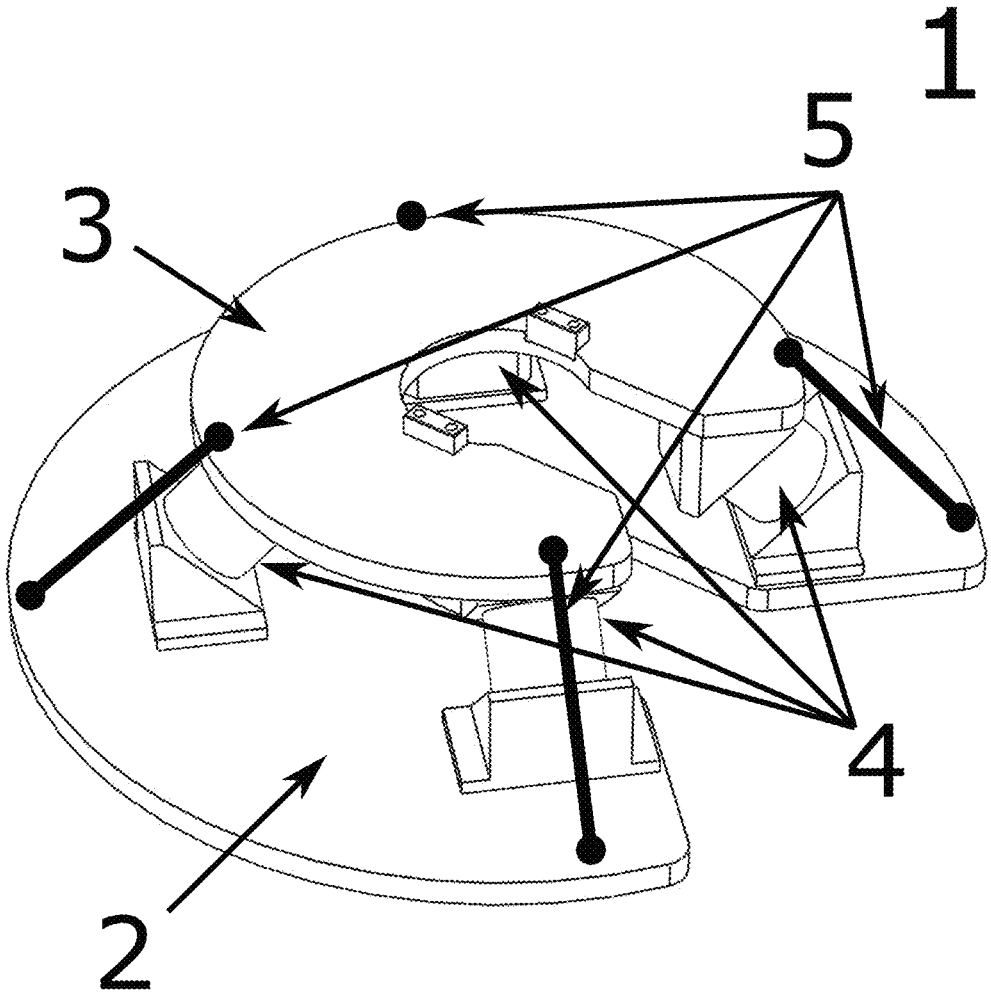
FIG. 1 illustrates a perspective view of an embodiment of the invention.

As shown in FIG. 1, illustrating an embodiment of the invention, a suspension device 1, preferably for suspending a marine drilling riser, or any other suspended work string, at the work deck, e.g. drill floor or cellar deck, of a floating vessel, such as a mobile offshore drilling unit (MODU), e.g. drill ship, drill rig or well intervention vessel, henceforth said suspension device 1 will also be referred to as a gimbal 1.

Said gimbal 1 comprise of a first frame 2 and a second frame 3, wherein the first frame 2 and the second frame 3 are adjoined together by plurality of cushioning units 4 and a plurality of tethering items 5. Said plurality of cushioning units 4 and plurality of tethering items 5 positioned in between the first frame 2 and the second frame 3 in a circumferential manner.

Said plurality of cushioning units 4 and plurality of tethering items 5 can be fixed to the edges of the first frame 2 and the second frame 3, on the surfaces of the first frame 2 and the second frame 3, such as, the top surface of the first frame 2 and the bottom surface of the second 3, or a combination thereof.

The first frame 2 and the second frame 3 can hold and suspend a marine drilling riser in its center. A preferred embodiment of said frames 2, 3 are of, but not limited to, circular type, wherein a riser is threaded through the gimbal 1. Other alternative embodiments of the shapes of said frames 2, 3 can be utilized in the gimbal 1 as found necessary.

An alternative embodiment of said frames 2, 3 is that they be in the form of a horseshoe, or U-shape configuration, allowing a riser to be fitted in the gimbal's 1 side.

The first frame 2 can be fixed to a deck of a MODU, which can be in a hole of drill deck or above-mentioned drill hole. Due to the above-mentioned configuration of the plurality of cushioning units 4 and the plurality of tethering items 5 in between said frames 2, 3, the second frame 3 is capable of pivoting in the transverse and longitudinal direction relative to the fixed first frame 2. The pivotability of the second frame 3 further provides the pivotability of the suspended marine drilling riser, thus assist in reducing bending moments acting on the marine drilling riser at the gimbal suspension point, when MODU is pitching and rolling in the ocean waves.

The plurality of cushioning units 4 can comprise of an elastomer material, such as rubber, in the form of rubber blocks. The plurality of cushioning units 4 can also be of a mechanical type such as, but not limited to, coil spring, pneumatic or hydraulic cylinders. One of the purposes of the cushioning units 4 is to provide a cushioning or damping effect and pivotability between the first frame 2 the second frame 3, when a marine drilling riser is suspended in the gimbal 1, wherein the most compressed cushioning unit indicates the general direction the riser is pivoting towards.

The cushioning units 4 that are in compression, will also be supported by the cushioning units 4 on the opposite side of the gimbal, in addition to the tethering items 5, whereas these cushioning items 4 tension provide a limited support in providing a tensioning support relative to the tethering items 5.

Figure 2:
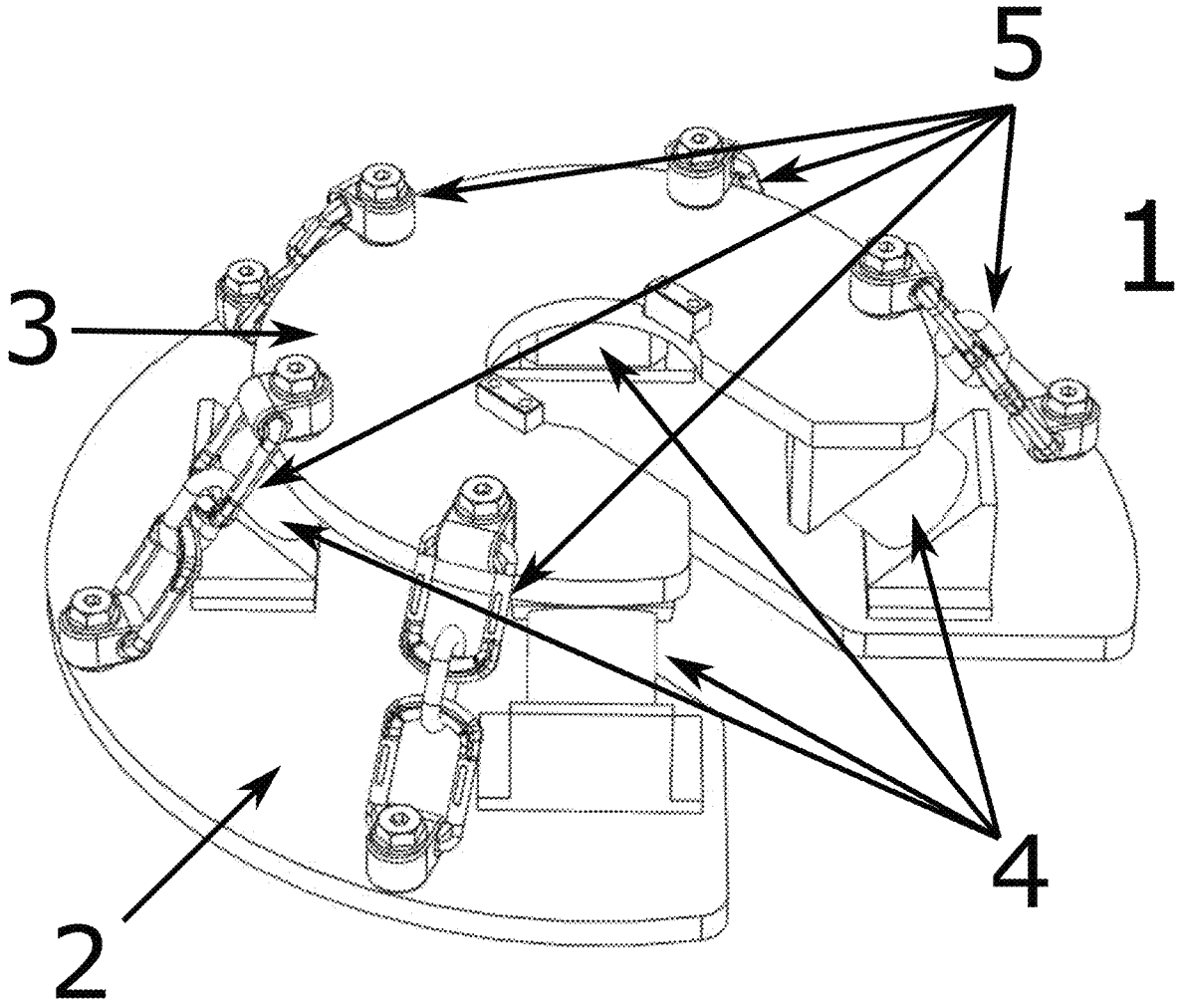
FIG. 2 illustrates a perspective view of an alternative embodiment of the invention wherein the tethering items are chains.
Figure 3:
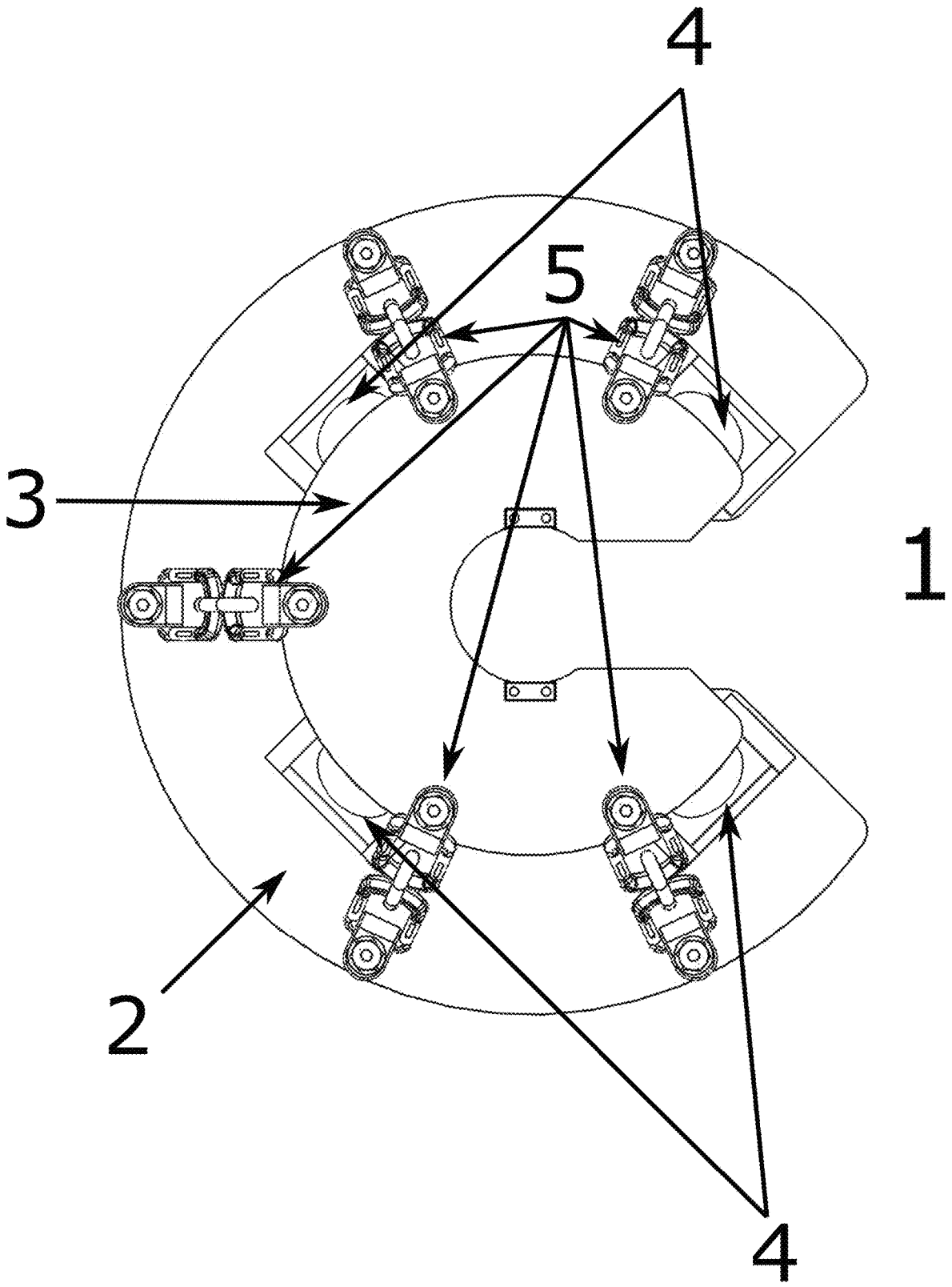
FIG. 3 illustrates a top down view of the alternative embodiment of the invention.

The plurality of tethering items 5 can comprise of a tether system such as, but not limited to, a metal wire or chains, as shown in FIGS. 2 and 3. Alternatively, it can comprise of a cord in made of textile material with high tensile strength, such as, but not limited to weaved carbon fiber.

One of the purposes of the plurality of tethering items 5 is to control the extent of compression and tension acting upon the cushioning units 4 when the second frame 3 is pivoting with the suspended marine drilling riser.

A further purpose of the tethering items 5 is to avoid high compression and/or tension from pivoting action by the riser acting on the gimbal 1, which may irreversibly deform parts—or all of the plurality of cushioning units 4. And with damaged cushioning units 4 of the gimbal increases the likelihood of riser to pivot to an extent that high bending moments will occur at the riser suspension point of the gimbal 1.

The cushioning units 4 can include sensors (not shown) that measures the compression force acting on the cushioning units 4. Similarly, the tethering items 5 can also include sensors (not shown) that measures the tensioning force acting on the tethering items 5. A receiver (not shown) can also receive the sensor data from the cushioning units 4 and tethering items 5, wherein said sensor data is provided to processor unit (not shown) for processing said sensor data for review by a gimbal operator.

In a situation where there is high compression and/or tension from pivoting action by the riser on the gimbal 1 that may damage the cushioning units 4, preferably the tethering items 5 will break or snap at a predetermined tensioning force before any irreversible damage occurs on the cushioning units 4. In this case, where there are sensors in the tethering item 5, a snapped tethering item 5 would transmit data which would indicate that the tether 5 is damaged.

The invention claimed is:

1. A gimbal device for suspending a riser on a mobile offshore drilling vessel (MODU), comprising a first frame, a second frame and a plurality of cushioning units, wherein each of said plurality of cushioning units are circumferentially positioned in between the first frame and the second frame, characterized in that the gimbal device further comprises a plurality of tethering items, which are separate from the cushioning units and configured to take up tensioning loads, wherein said plurality of tethering items are circumferentially positioned in between the first frame and the second frame.

2. The gimbal device according to claim 1, wherein the first frame is fixed to a deck of said MODU.

3. The gimbal device according to claim 1, wherein the second frame is pivotable in a transverse and a longitudinal direction relative to the first frame.

4. The gimbal device according to claim 1, wherein said plurality of cushioning units comprises an elastomer material, coils pneumatic-or hydraulic cylinders.

5. The gimbal device according to claim 1, wherein said plurality of tethering items have a predetermined length adapted to limit the compression or tension of said plurality of cushioning units.

6. The gimbal device according to claim 1, wherein said plurality of cushioning items can be fixed on the surfaces or the edges of the first frame and the second frame.

7. The gimbal device according to claim 1, wherein said plurality of tethering items can be fixed on the surfaces or the edges of the first frame and the second frame.

8. The gimbal device according to claim 1, wherein said plurality of tethering items comprise of wire or chains.

9. The gimbal device according to claim 1, wherein said plurality of tethering items comprise of textile material.

* * * * *